United States Patent [19]

Divers et al.

[11] 4,180,352

[45] Dec. 25, 1979

[54] EXTENSIBLE BRATTICE AND CANTILEVERED ROOF MOUNTED SUPPORT SYSTEM THEREFOR

[75] Inventors: Edward F. Divers, Pittsburgh, Pa.; D. Randolph Berry, Sudbury; David A. Monaghan, Newtonville, both of Mass.

[73] Assignee: The United States of America as represented by the Secretary of the Interior, Washington, D.C.

[21] Appl. No.: 958,578

[22] Filed: Nov. 7, 1978

[51] Int. Cl.[2] ..... E21F 1/00; E21F 3/00

[52] U.S. Cl. ..... 405/303; 98/50; 160/330; 405/259

[58] Field of Search ..... 405/288, 132, 303, 259, 405/260; 98/50; 299/12, 19; 49/127, 209; 160/330

[56] References Cited

U.S. PATENT DOCUMENTS

| | | | |
|---|---|---|---|
| 2,947,239 | 8/1960 | Burgess | 98/50 |
| 3,306,180 | 2/1967 | Asbury | 98/50 |
| 3,715,969 | 2/1973 | Burgess | 160/330 X |

*Primary Examiner*—Dennis L. Taylor

*Attorney, Agent, or Firm*—Thomas Zack; Donald A. Gardiner

[57] ABSTRACT

An extensible brattice and cantilevered support system therefor comprises a brattice panel having first and second top sleeves and a weighted bottom sleeve suspended from selected roof bolts by a support system comprising a support to which the brattice panel is mounted and which defines a track, and mounting apparatus for each roof bolt comprising a coupler connected to the panel support in sliding engagement with the support track, an elongate member connected to the coupler, an upstanding, roof abutting leg member connected to the elongate member at a location longitudinally spaced from the coupler, and a member connecting the elongate member in depending relation to the associated roof bolt at a position on the elongate member intermediate the coupler and leg member.

10 Claims, 3 Drawing Figures

EXTENSIBLE BRATTICE AND CANTILEVERED ROOF MOUNTED SUPPORT SYSTEM THEREFOR

FIELD OF THE INVENTION

The present invention relates in general to extensible brattices for underground mine face ventilation, and in particular to an extensible cantilevered brattice system adapted to be mounted from the roof bearing plates in room-and-pillar coal mining sections using exhaust face ventilation.

BACKGROUND OF THE INVENTION

Brattice panel mine ventilating systems have long been known in the art, as evidenced by the systems disclosed in U.S. Pat. Nos. 1,778,979 (Lockhart), and 2,947,239 (Burgess). However, such simple brattice systems require disassembly of the panels from their means of support in order to permit extension thereof to new locations. Previous attempts to provide extensible panel systems have resulted in complicated systems which require floor jacks or some other form of ground support. Two examples of such prior art extensible systems are disclosed in U.S. Pat. Nos. 3,464,756 and 3,715,969, both to Burgess.

Accordingly, it is an object of the present invention to provide an extensible brattice panel with a roof bolt suspension system that does not require ground support.

It is a further object of the invention to provide an adjustable system which is not dependent on predetermined roof bolt locations.

It is a still further object of the invention to provide an extensible brattice panel and suspension system which creates an effective seal against both the mine roof and floor.

It is another object of the invention to provide an extensible brattice panel which employs lightweight hardware of minimum size for increased safety, and which can be easily fabricated from readily available components for reduced cost.

It is yet another object of the invention to provide an extensible brattice panel system which permits continuous straight line extension of the brattice panel without having to lift or remove the panel.

SUMMARY OF THE INVENTION

These and other objects are accomplished by an extensible brattice panel and cantilevered support system therefor constructed in accordance with the present invention. In a preferred embodiment, the brattice panel is provided with first and second top sleeves and a weighted bottom sleeve running the length of the panel. The first and second top sleeves cooperate with a preferred embodiment of the support systems to provide a seal against the mine roof, while the bottom sleeve provides a seal against the mine floor.

In a preferred embodiment, the support system comprises a support to which the brattice panel is mounted and which defines a track; and mounting apparatus for suspending the panel support from selected roof bolts. The mounting apparatus comprises a coupler connected to the panel support in sliding engagement with the support track, so as to allow displacement of the support, and hence extension of the panel, relative to the mounting apparatus.

The mounting apparatus of the present invention further comprises an elongate member connected to the coupler, which member preferably defines a longitudinal slot therein; an upstanding leg member connected to the elongate member at a location longitudinally spaced from the coupler and such that the distal end of the leg member, which preferably is curved to define a roller surface, abuts the mine roof when the elongate member is in the operative positive thereof; and a connecting member, which is preferably adapted for sliding engagement with the slot of the elongate member, for connecting the elongate member in depending relation to the selected roof bolts at a position on the elongate member intermediate the coupler and leg member, and such that the position at which the connecting member is connected to the elongate member, and hence the spacing of the brattice panel from the selected roof bolts, may be varied.

In accordance with another aspect of the invention, the connecting member is adjustable so as to allow the vertical spacing of the panel support with respect to the roof to be varied.

In accordance with a further aspect of the invention, the panel support preferably comprises a channel-shaped member defining a downwardly facing recess which constitutes the track, and the coupler comprises rollers adapted such that the coupler depends from the channel-shaped member. The support further comprises a line, which cooperates with the second top brattice panel sleeve to support the panel, disposed above the channel-shaped member and offset toward the side thereof which is relatively nearer the roof bolts supporting the system. The channel-shaped member is prestressed by the line to compensate for loaded deflection thereof, and the brattice panel is draped on the channel-shaped member with a portion of the first top sleeve portion of the panel in sealing contact with the roof when the panel is mounted on the line and the channel-shaped member is disposed in the operative position thereof.

Other features and advantages of the invention will be set forth in, or apparent from, the detailed description of the preferred embodiment found hereinbelow.

DETAILED DESCRIPTION OF THE PREFERRED EMBODIMENTS

Figure 1:
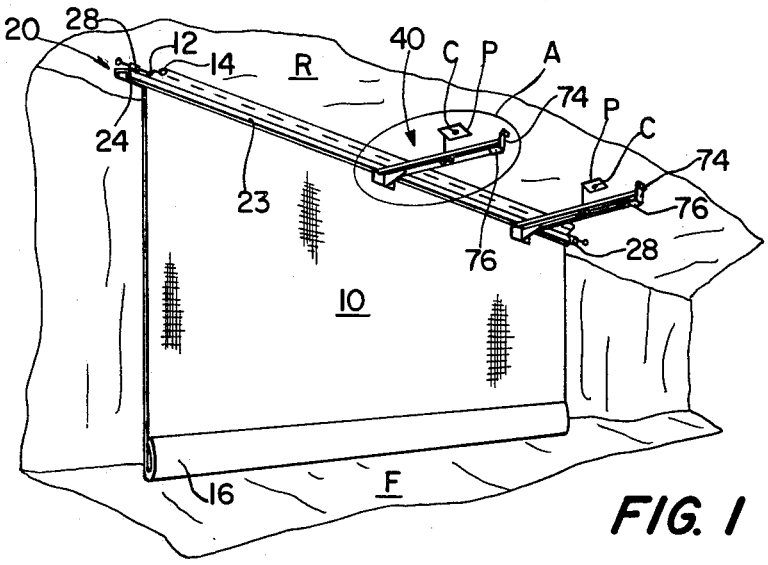
FIG. 1 is a perspective view of a preferred embodiment of a brattice panel and support system constructed in accordance with the present invention.
Figure 2:
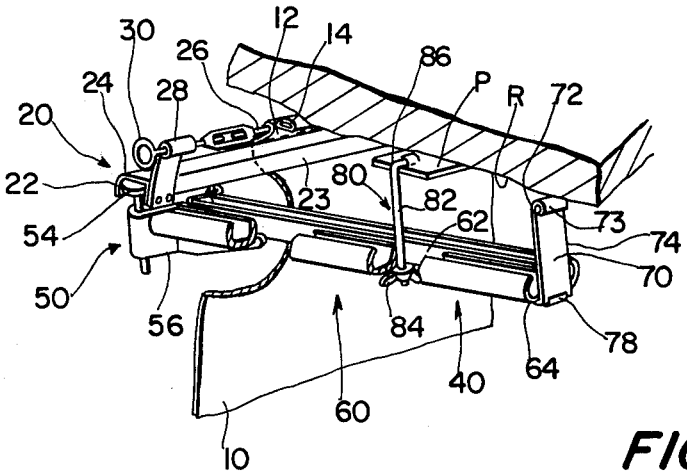
FIG. 2 is an enlarged detail view, partially broken away, of the portion of the panel and support system illustrated in FIG. 1 which is encompassed within circle A of FIG. 1.
Figure 3:
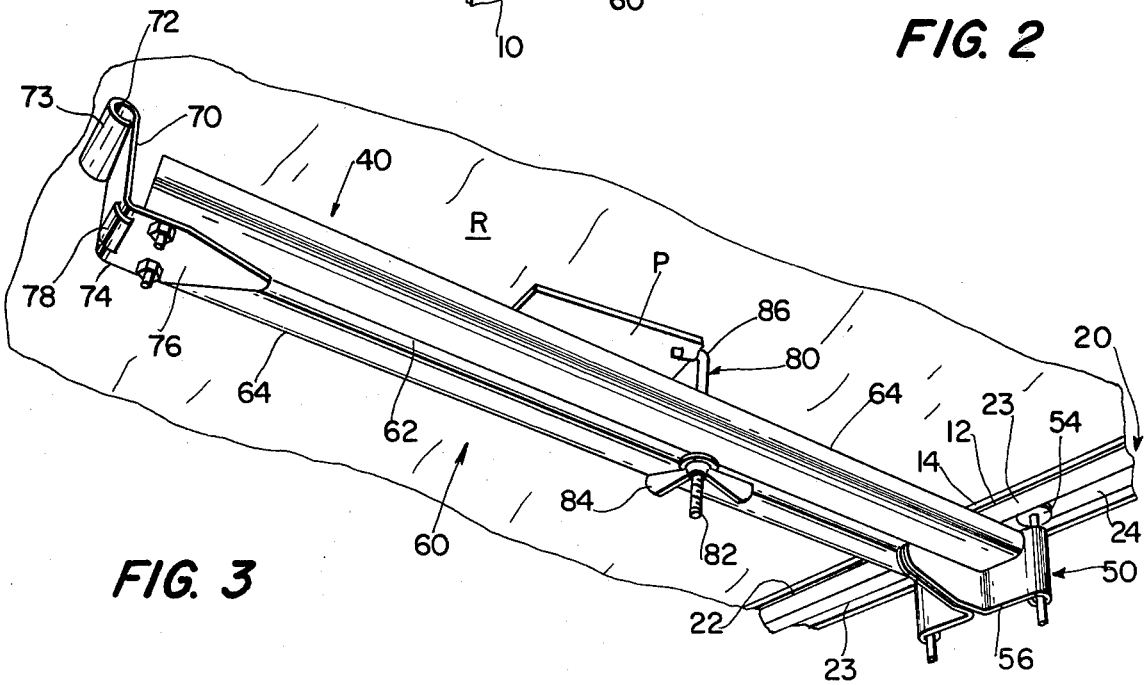
FIG. 3 is an enlarged view of apparatus 40 illustrated in FIG. 1, looking from another direction.

Referring to the figures, a preferred embodiment of a brattice panel constructed in accordance with the present invention comprises a body portion 10, first and second top sleeves 12 and 14, respectively, and a bottom sleeve 16. Top sleeves 12 and 14 are adapted to cooperate with the support system of the present invention, as will be described in more detail hereinbelow, to provide a seal against the roof R of a mine section. Bottom sleeve 16 preferably is relatively large, as shown, and is weighted, advantageously with coal, chain or other available material, to provide a seal against the mine floor F. The panel may be fabricated using any conventional materials.

Continuing to refer to the figures, a preferred embodiment of a support system constructed in accordance with the present invention basically comprises a support, generally denoted 20, to which the brattice panel is mounted, preferably in the manner to be described hereinbelow; and mounting apparatus, generally denoted 40, for suspending support 20 from selected ones of the roof bolts.

Support 20 preferably comprises, as shown, a channel-shaped member 22 defining a downwardly facing recess which constitutes a track 24, and a cable or line 26 mounted on member 22 by means of two brackets 28 so as to be disposed above member 22 parallel to, and offset from, the longitudinal axis thereof, toward the side of channel 22 which is relatively nearer the selected roof bolts C from which support 20 is to be suspended. Line 26 is preferably mounted to brackets 28 as shown by means of an eyebolt and turnbuckle arrangement, generally denoted 30, associated with each bracket 28, which allow the tension of line 26 to be adjusted.

Line 26 serves to pre-stress member 22 to compensate for loaded deflection thereof, and also serves to mount the brattice panel on support 20 by being received within second top sleeve 12 of the panel. So mounted, body portion 10 of the panel is draped across channel-shaped member 22 such that sleeves 12 and 14 are inclined with respect to roof R, and topmost sleeve 14 is urged into sealing contact with roof R when member 22 is disposed in the operative position thereof.

Mounting apparatus 40 preferably comprises, for each roof bolt C from which support 20 is to be suspended, as shown, a coupler, generally denoted 50, connected to support 20 in sliding engagement with track 24 so as to allow displacement of support 20, and hence extension of the brattice panel, relative to apparatus 40; an elongate member, generally denoted 60, connected to coupler 50; an upstanding leg member 70 connected to elongate member 60 at a location longitudinally spaced from coupler 50, and such that the distal end 72 thereof abuts mine roof R when elongate member 60 is in the operative position thereof; and a connector, generally denoted 80, for connecting elongate member 60 in depending relation to the associated roof bolt C at a position on elongate member 60 which is intermediate between coupler 50 and leg member 70.

For ease of construction, coupler 50 advantageously may comprise a conventional, readily available roller unit of the type which is commonly employed for sliding garage doors, and which comprises a pair of disk or wheel-shaped rollers 54 rotatably mounted in a frame 56, as shown. Frame 56 is connected to elongate member 60 such that rollers 54 have a relatively vertical axis of rotation and the circumferential edges of rollers 54 contact the depending legs 23 of channel shaped member 22.

Elongate member 60 preferably is configured, as shown, so as to define a longitudinal slot 62 therein which cooperates with connecting member 80 so as to allow the position at which member 80 is connected to member 60, and hence the spacing of the brattice panel from the supporting roof bolts C, to be varied. For ease of construction, and for strength and lightness, elongate member 60 advantageously comprises two upwardly facing channel-shaped portions 64 joined together by coupler 50 and leg member 70 in spaced apart relationship so as to define slot 62.

Leg member 70 preferably is configured, as shown, such that distal end 72 is curved so as to define a roller surface 73 having an axis of rotation relatively parallel to the brattice panel. It will be appreciated by those skilled in the art that roller surface 73 facilitates vertical adjustment of support 20 with respect to roof R. Preferably, as shown, leg member 70 also constitutes the upstanding leg of an angle bracket 74, the other leg 76 of which joins portions 64 of channel-shaped member 60 together. Bracket 74 also has a bend which is reinforced by a curved reinforcing member 78, as shown.

Connector 80 preferably simply comprises a threaded bolt 82 whch extends through longitudinal slot 62 and a wing-nut 84 mounted on bolt 82 so as to abut the underside of elongate member 60. The distal end 86 of bolt 82 is adapted for mounting to roof bolt C. In the illustrated embodiment, distal end 86 is in the form of a hook cooperates with a standard indented roof bolt bearing plate P, as shown.

As will be understood by those skilled in the art, a brattice panel constructed in accordance with the present invention and mounted on support 20 is hung in position simply by suspending a mounting apparatus 40 from each roof bolt C to be used in the manner described hereinabove, with the location of bolt 82 within slot 62 determined by the relative locations of the associated roof bolt C and the desired location of the brattice panel; and then by positioning channel-shaped member 22 such that rollers 54 of each mounting apparatus 40 are received within track 24. The brattice panel may be extended simply by axially displacing member 22 with respect to each mounting apparatus 40. A brattice panel may be extended indefinitely simply by relocating a mounting apparatus 40 which is no longer needed to a roof bolt C near the path of extension and such that rollers 54 thereof are in the path of extension, and then displacing member 22 onto the roller 54 of the relocated mounting apparatus 40.

Although the invention has been described with respect to an exemplary embodiment thereof, it will be understood that variations and modifications can be effected in the embodiment without departing from the scope or spirit of the invention.

We claim:

1. A cantilevered support system for an extensible mine ventilation brattice which is adapted to cooperate with roof bolts in the mine, the system comprising:

support means to which the brattice is mounted, and which defines a track; and mounting means for suspending said support means from at least one of the roof bolts, said mounting means comprising:

coupling means connected to said support means in sliding engagement with said track so as to allow displacement of said support means, and hence extension of the brattice, relative to said mounting means;

an elongate member connected to said coupling means;

an upstanding leg member connected to said elongate member at a location longitudinally spaced from said coupling means, and such that the distal end of said leg member abuts the mine roof when said elongate member is in the operative position thereof; and connecting means for connecting said elongate member in depending relation to the at least one of the roof bolts at a position on said elongate member intermediate said coupling means and said leg member.

2. The support system of claim 1 wherein said elongate member defines a longitudinal slot therein and said connecting means is adapted to slidingly engage with said slot so as to allow the position at which said connecting member is connected to said elongate member, and hence the spacing of the brattice from the at least one of the roof bolts, to be varied.

3. The support system of claim 2 wherein said elongate member comprises two channel-shaped portions joined together by said coupling means and said leg member in spaced apart relationship so as to define said slot.

4. The support system of claim 1 wherein the distal end of said leg member is provided with means defining a curved roller surface having an axis of rotation relatively parallel to the brattice.

5. The support system of claim 1 wherein said connecting means is adjustable so as to allow the vertical spacing of said support member with respect to the roof to be varied.

6. The support system of claim 5 wherein said connecting means comprises a threaded bolt which extends through said slot and a wing-nut mounted on said bolt so as to abut the underside of said elongate member which faces away from the roof.

7. The support system of claim 1 wherein said coupling means comprises roller means adapted to cooperate with said track.

8. The support system of claim 7 wherein said track is in the form of a downwardly facing recess disposed in said support means and said roller means is adapted such that said coupling means depends from said support means.

9. The support system of claim 1 wherein said support means comprises a channel-shaped member defining said track and a line on which the brattice is mounted connected to said channel-shaped member so as to be disposed above said channel-shaped member and offset toward the side thereof which is relatively nearer the at least one of the roof bolts, and such that said channel-shaped member is prestressed to compensate for loaded deflection thereof and a brattice mounted on said line is draped across said channel-shaped member with a portion of the brattice inclined with respect to the roof for sealing contact therewith when said support means is disposed in the operative position thereof.

10. A mine brattice system which is adapted to cooperate with roof bolts in the mine, said system comprising:

a brattice panel comprising first and second top sleeves and a weighted bottom sleeve, said bottom sleeve providing a seal against the mine floor; and cantilevered mounting means for suspending said brattice panel at a location spaced from at least one of the roof bolts, said mounting means comprising an elongate support member, and a line, which cooperates with said second top brattice panel sleeve to support said brattice panel, disposed above said support member and toward the side thereof which is relatively nearer the at least one of the bearing plates such that said support member is prestressed to compensate for loaded deflection thereof, and such that said brattice panel is draped across said support member with said first top sleeve in sealing contact with the roof when said brattice panel is mounted on said line and said support member is disposed in the operative position thereof.

* * * * *